US010669885B2

(12) United States Patent
Pecchiol et al.

(10) Patent No.: US 10,669,885 B2
(45) Date of Patent: Jun. 2, 2020

(54) METHODS OF WASHING GAS TURBINE ENGINES AND GAS TURBINE ENGINES

(71) Applicant: Nuovo Pignone SRL, Florence (IT)

(72) Inventors: Mario Pecchiol, Florence (IT); Celia Navarro Canales, Queretaro (MX); Tommaso Olivieri, Florence (IT); Jorge Omar Manon Cantu, Queretaro (MX)

(73) Assignee: NUOVO PIGNONE SRL, Florence (IT)

( * ) Notice: Subject to any disclaimer, the term of this patent is extended or adjusted under 35 U.S.C. 154(b) by 341 days.

(21) Appl. No.: 15/102,079

(22) PCT Filed: Dec. 4, 2014

(86) PCT No.: PCT/EP2014/076562
§ 371 (c)(1),
(2) Date: Jun. 6, 2016

(87) PCT Pub. No.: WO2015/082609
PCT Pub. Date: Jun. 11, 2015

(65) Prior Publication Data

US 2016/0356176 A1 Dec. 8, 2016

(30) Foreign Application Priority Data

Dec. 6, 2013 (IT) ..... MI2013A2042

(51) Int. Cl.
*B08B 3/02* (2006.01)
*F01D 5/02* (2006.01)
(Continued)

(52) U.S. Cl.
CPC ..... *F01D 25/002* (2013.01); *B08B 3/02* (2013.01); *B08B 9/093* (2013.01); *F01D 5/02* (2013.01);
(Continued)

(58) Field of Classification Search
CPC .... F01D 25/002; F01D 25/007; F04D 29/701; F04D 29/705; F04D 29/321; B08B 9/093; B08B 9/0813; B08B 3/08; B08B 3/02
See application file for complete search history.

(56) References Cited

U.S. PATENT DOCUMENTS 5,273,395 A 12/1993 McDermott
5,944,483 A 8/1999 Beck et al.
(Continued)

FOREIGN PATENT DOCUMENTS

CN 1908383 A 2/2007
CN 100478088 C 4/2009
(Continued)

OTHER PUBLICATIONS

Syverud E, Bakken LE. Online Water Wash Tests of GE J85-13. ASME. J. Turbomach. 2007;129(1):136-142. doi:10.1115/1.2372768.*
(Continued)

*Primary Examiner* — Ninh H. Nguyen
*Assistant Examiner* — Brian P Wolcott
(74) *Attorney, Agent, or Firm* — Baker Hughes Patent Organization

(57) ABSTRACT

Washing of the gas turbine engine, during operation of the gas turbine engine, comprises a washing phase that consists in spraying a detergent liquid substance towards the inlet of the compressor of the engine; the mass flow of the detergent liquid substance to be sprayed is set so that the liquid-to-gas ratio at the inlet of the compressor is more than 1% and less than 5% with reference to the rated mass flow of the compressor; the washing phase comprises a first sub-phase during which the flow of the detergent liquid substance is
(Continued)

increased gradually and a second sub-phase during which the flow of the detergent liquid substance is maintained constant.

17 Claims, 3 Drawing Sheets

(51) Int. Cl.
*B08B 9/093* (2006.01)
*F01D 25/00* (2006.01)
*F04D 29/32* (2006.01)

(52) U.S. Cl.
CPC ..... *F04D 29/321* (2013.01); *F05D 2220/32* (2013.01)

(56) References Cited

U.S. PATENT DOCUMENTS

| | | | | |
|---|---|---|---|---|
| 6,073,637 | A * | 6/2000 | Hayward | B08B 3/02 134/198 |
| 7,428,906 | B2 * | 9/2008 | Asplund | B08B 3/02 134/169 R |
| 8,216,392 | B2 * | 7/2012 | Giljohann | B08B 3/02 134/166 R |
| 2007/0000528 | A1 | 1/2007 | Asplund et al. | |
| 2007/0028947 | A1 | 2/2007 | Erickson et al. | |
| 2008/0087300 | A1 | 4/2008 | Kohler et al. | |
| 2010/0206966 | A1 | 8/2010 | McDermott | |
| 2013/0174869 | A1 | 7/2013 | Roesing et al. | |

FOREIGN PATENT DOCUMENTS

| | | | |
|---|---|---|---|
| EP | 0 275 987 | A2 | 7/1988 |
| EP | 0275987 | A2 | 7/1988 |
| EP | 0781897 | A2 | 7/1997 |
| EP | 1 970 133 | A1 | 9/2008 |
| EP | 1970133 | A1 | 9/2008 |
| EP | 2286933 | A1 | 2/2011 |
| EP | 2562430 | A1 | 2/2013 |
| EP | 2565391 | A1 | 3/2013 |
| GB | 2484337 | A | 4/2012 |
| JP | 2004-211641 | A | 7/2004 |
| JP | 2005-133583 | A | 5/2005 |
| JP | 2011-041944 | A | 3/2011 |
| RU | 2 373 411 | C2 | 11/2009 |
| RU | 2 412 086 | C2 | 2/2011 |
| WO | 2011089155 | A2 | 7/2011 |

OTHER PUBLICATIONS

Pecchioli et al., Jun. 6, 2016, U.S. Appl. No. 15/102,071.
Italian Search Report and Written Opinion issued in connection with corresponding Application No. ITC020130064, dated Mar. 28, 2014.
Italian Search Report and Written Opinion issued in connection with corresponding Application No. MI2013A002042, dated Sep. 15, 2014.
International Search Report and Written Opinion issued in connection with corresponding Application No. PCT/EP2014/076562, dated Feb. 4, 2015.
International Search Report and Written Opinion issued in connection with corresponding Application No. PCT/EP2014/076563, dated Feb. 20, 2015.
Syverud et al., "Online Water Wash Tests of GE J85-13", Transactions of the ASME, vol. No. 129, pp. 136-142, Jan. 2007.
Unofficial English Translation of Chinese Office Action issued in connection with corresponding CN Application No. 201480066662.7 dated Mar. 20, 2017.
Decision to Grant issued in connection with corresponding RU Application No. 2016122202 dated May 22, 2018.
Machine Translation Office Action issued in connection with corresponding JP Application No. 2016-536606 dated Oct. 9, 2018.

* cited by examiner

METHODS OF WASHING GAS TURBINE ENGINES AND GAS TURBINE ENGINES

TECHNICAL FIELD

Embodiments of the subject matter disclosed herein relate to methods of washing gas turbine engines as well as gas turbine engines.

BACKGROUND

As it is known, gas turbine engines, in particular their compressors, are affected by fouling and therefore need to be cleaned repeatedly during their lifetime.

A common way to clean a gas turbine engine consists in interrupting its normal operation and washing it, without disassembling the engine. This is the so-called "off-line" washing and is carried out by means of a liquid detergent. After treatment with the liquid detergent, rinsing is often necessary. Off-line washing is very effective; anyway, it implies interrupting normal operation and therefore increases the downtime of the machine and of the plant including the machine.

It is also known, even if less common, to wash a gas turbine engine during operation, i.e. when the engine generates work. This is the so-called "on-line" washing and consists in adding a liquid detergent to the gas flowing in the compressor. In this case, the quantity of liquid detergent added to the gas is small (more precisely the liquid-to-gas ratio is maintained low) and the pressure of the ejected liquid detergent is low in order to avoid:

- disturbing the operation of the compressor and/or the turbine and/or the combustor (for example the combustion may extinguish due to the liquid detergent),
- disturbing the fluid flow inside the compressor,
- damaging the components of the compressor (for example liquid detergent droplets, if any, may hit against e.g. the rotating blades of the compressor).

It is to be noted that liquid detergents use for "off-line" washing are usually different from liquid detergents used for "on-line" washing.

Known on-line washing methods are much less effective then known off-line washing methods, even if they have the advantage of not affecting the downtime of the machine and of the plant including the machine.

It's also known from the document "Online Water Wash Tests of GE J85-13" by Elisabet Syverud and Lars E. Bakken to wash a gas turbine injecting water, with a water-to-air ratio ranging from 0.4% to 3% by mass, while the machine is operating.

BRIEF DESCRIPTION OF THE INVENTION

Therefore, there is a need for an improved way of washing gas turbine engines and for devices allowing it.

A first aspect of the present invention is a method of washing a gas turbine engine.

The method is used for washing a gas turbine engine during operation of the gas turbine engine; the method comprises a washing phase that consists in spraying a detergent liquid substance towards the inlet of the compressor of the engine; the mass flow of the detergent liquid substance to be sprayed is set so that the liquid-to-gas ratio at the inlet of the compressor is more than 1% and less than 5% with reference to the rated mass flow of the compressor. The washing phase comprises a first sub-phase during which the flow of the detergent liquid substance is increased gradually, and a second sub-phase during which the flow of the detergent liquid substance is maintained constant.

A second aspect of the present invention is a gas turbine engine.

The gas turbine engine comprises a compressor, a turbine downstream of the compressor, and a plurality of nozzles for spraying a detergent liquid substance towards the inlet of the compressor; more particularly, the engine comprises further a control unit arranged so to carry out the method as set out above.

BRIEF DESCRIPTION OF DRAWINGS

The accompanying drawings, which are incorporated herein and constitute a part of the specification, illustrate exemplary embodiments of the present invention and, together with the detailed description, explain these embodiments. In the drawings.

DETAILED DESCRIPTION

The following description of exemplary embodiments refers to the accompanying drawings.

The following description does not limit embodiments of the present invention. Instead, the scope of the invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
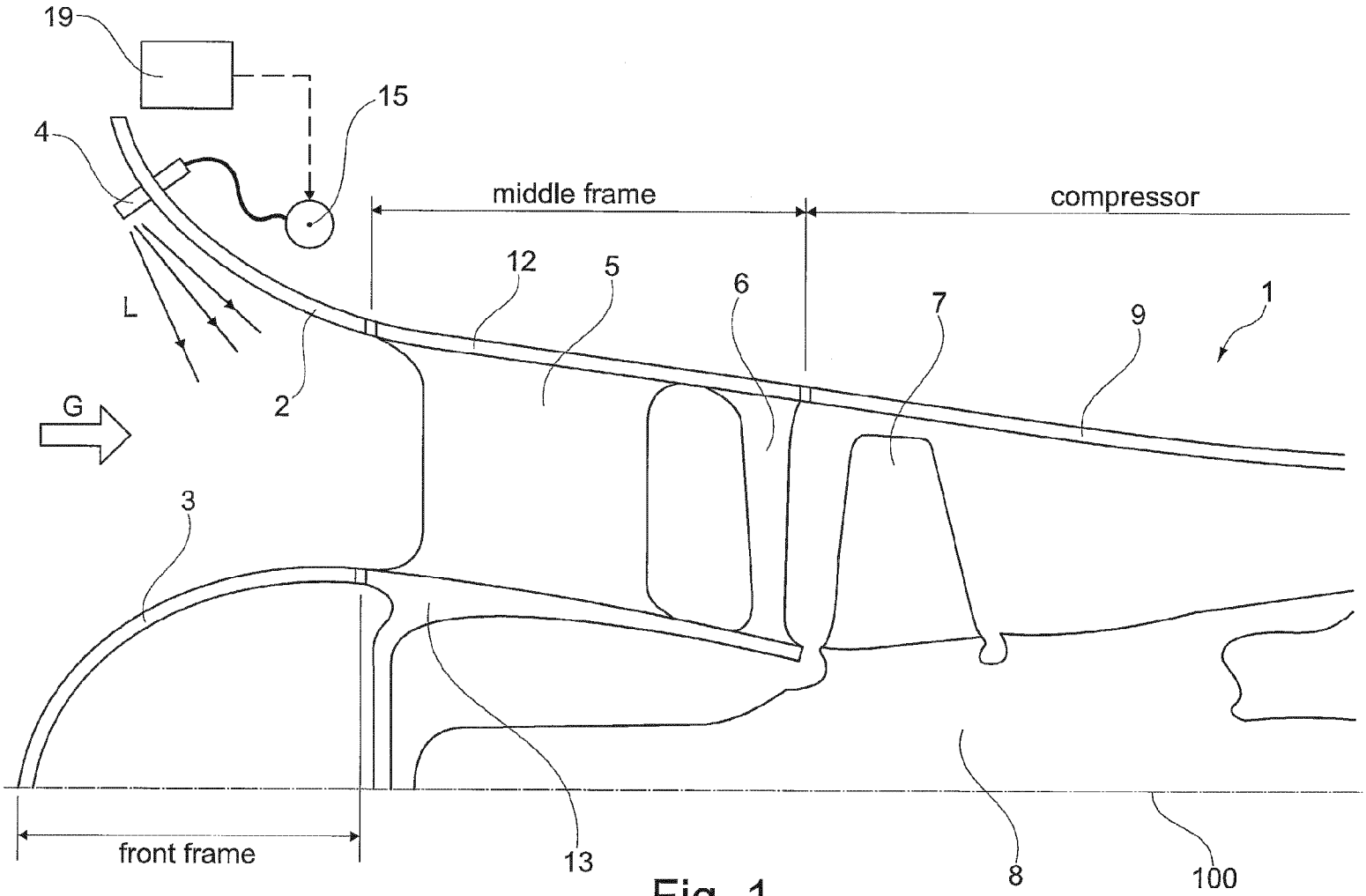
FIG. 1 shows a simplified view of an embodiment of a compressor of a gas turbine engine.

FIG. 1 is a cross-section half view and shows partially an embodiment of a gas turbine engine; in particular, it shows a front frame, including a bell mouth 2 and a bullet nose 3, a (optional) middle frame, including struts 5 and inlet guide vanes 6, and a compressor 1, including a rotor (see references 7 and 8) and a stator (see reference 9). The front frame, in particular the bell mouth 2 and the bullet nose 3, and the middle frame, in particular its outer wall 12 and its inner wall 13, define an inlet path that leads to the inlet of the compressor 1. Just after the inlet of the compressor 1, there is the first rotor stage of the compressor (only one blade 7 is shown). Sometimes, the combination of the front frame, the middle frame and the compressor 1 is called altogether "compressor".

In general, a gas turbine engine comprises the series connection of a compressor (such as the one shown partially in FIG. 1), a combustion chamber with combustion devices (not shown in FIG. 1), and a turbine (not shown in FIG. 1).

In FIG. 1, only few of the components of the rotor and the stator of the compressor 1 are shown; in particular, the shaft 8 of the rotor, one blade 7 of the first stage of the rotor, the casing 9 of the stator; in particular, there are not shown any of the blades of the other stages of the rotor and any of the vanes of the stages of the stator.

In the solution of FIG. 1, there is a plurality of nozzles 4 (only one is shown) for spraying a detergent liquid substance L towards the inlet of the compressor 1.

In this embodiment, the nozzles 4 are located at the mouth 2, i.e. at the smooth converging surface used to direct gas towards the first stage of the compressor, in particular to direct gas G into the inlet path leading to the inlet of compressor 1 through the struts 5 and the inlet guide vanes 6.

Nozzles 4 eject the detergent liquid substance L and atomize it; in this way, the droplets of the liquid L may be entrained by the flow of the gas G (see FIG. 1).

The detergent liquid substance L is sprayed at a certain distance from the external wall (see references 2 and 12) of the inlet path of the compressor 1 and at a certain distance from the internal wall (see references 3 and 13) of the inlet path of the compressor 1 and in a certain direction (see FIG. 1) so to ensure a good and appropriate distribution of the liquid in the gas flow inside the inlet path.

In the embodiment of FIG. 1, the average direction of the liquid substance L is inclined with respect to the average direction of the gas G.

In the embodiment of FIG. 1, the nozzles 4 are located on a circle (centered on the axis 100 of the engine) and at the same distance from each other; in particular, all the nozzles 4 are fluidly connected to a single manifold 15 that is beneficially shaped as a circle (centered on the axis 100 of the engine and located behind the bell mouth 2).

There is also a control unit 19 operatively connected to the manifold 15 so to control the ejection of the detergent liquid substance L; in this way, all the nozzles 4 eject the same quantity of liquid substance at the same time.

An embodiment of a nozzle 4 is shown in FIG. 2 and it may be used for spraying a liquid substance, in particular the detergent liquid substance L in the embodiment of FIG. 1.

Nozzle 4 comprises an elongated cylindrical body 20 having a first end 20-1 for receiving the liquid substance L and a second end 20-4 for ejecting the liquid substance L. There is also a first intermediate part 20-2 and a second intermediate part 20-3; part 20-2 is used for securing the nozzle 4 to the mouth 2; part 20-3 is used for establishing a distance between the ejection point and the external wall (see references 2 and 12) of the inlet path.

A conduit 21 for the flow of the liquid substance L is internal to the elongated cylindrical body 20 and extends from the first end 20-1, through the intermediate parts 20-2 and 20-3, up to the second end 20-4.

A recess 22 is located at the end 20-4, and the conduit 21 ends in the recess 22; when the liquid substance L reaches the recess 22, it is ejected from the recess 22 and sprayed; the level of atomization depends on the pressure upstream the recess 22 and the shape of the recess 22. In order to increase the pressure, the conduit 21 has a certain (relatively large) cross section at its begin portion 21-1, i.e. at the first end 20-1, and smaller cross section at its end portion 21-2, i.e. at the second end 20-4.

Figure 2A:
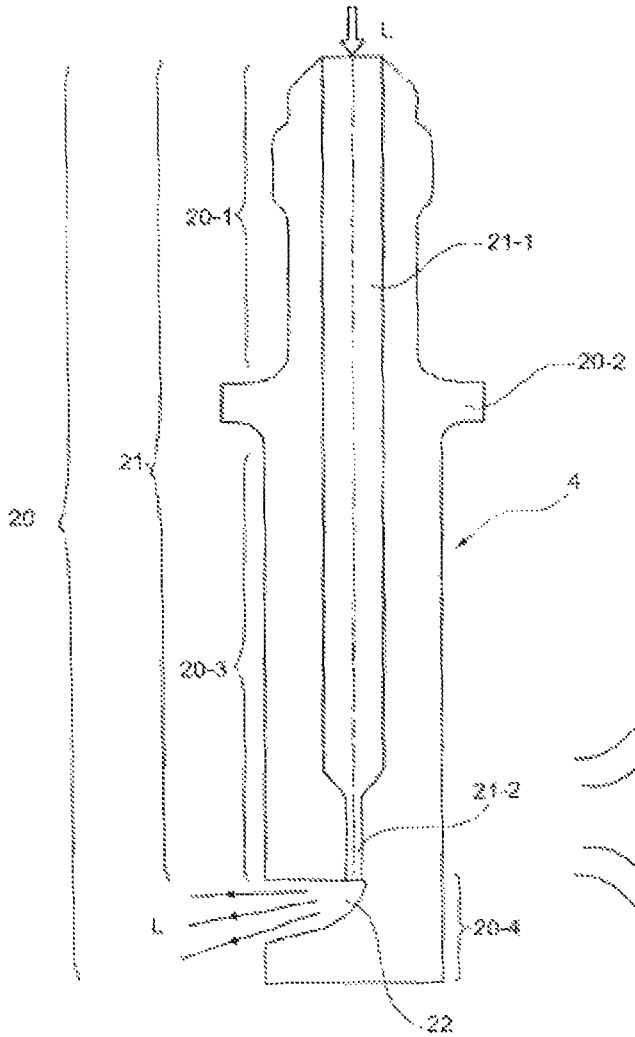
FIG. 2 shows simplified views of an embodiment of a nozzle (FIG. 2A corresponds to a longitudinal cross-section and FIG. 2B corresponds to a transversal cross-section)
Figure 2B:
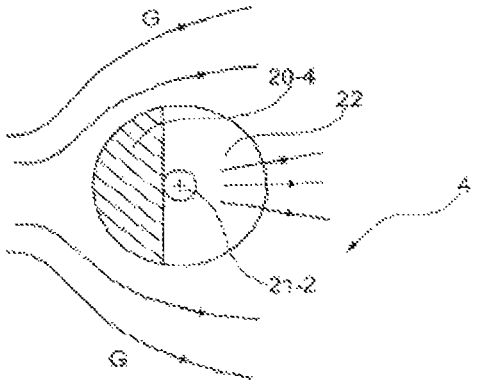

In the embodiment of FIG. 2, the recess 22 is arranged as a diameter of the cylindrical body 20 and opens towards the lateral surface of the cylindrical body 20; in this way, the gas G flows around the cylindrical body 20 (see in particular FIG. 2B) and the liquid L is protected by the cylindrical body 20 (see in particular FIG. 2B); in the embodiment of FIG. 1, the nozzles 4 are located far from where there is a high gas G flow.

In the embodiment of FIG. 2, a good ejection of the liquid substance L is obtained by a conduit 21, specifically its end portion 21-2, tangential to the bottom of the recess 22 (see in particular FIG. 2A); in any a case, the conduit might be at a small axial distance from to the bottom of the recess 22.

The direction and the aperture of the ejected liquid substance L depend also on the shape of the cross section of the recess 22. In the embodiment of FIG. 2, this shape is partially flat (see portion close to the mouth surface) and partially curved (see FIG. 2A), for example an arc of circle or parabola or hyperbola; the portion joining the flat one and the curved one corresponds to the bottom of the recess 22.

According to embodiments of the method, washing of a gas turbine engine is carried out during operation of the gas turbine engine and comprises a washing phase that consists in spraying a detergent liquid substance towards the inlet of the compressor of the engine; spraying may be carried out as shown in FIG. 1, i.e. upstream the struts and the inlet guide vanes; spraying may be carried out as shown in FIG. 1, i.e. from the mouth of the compressor.

In an embodiment, the mass flow of the detergent liquid substance to be sprayed is set so that the liquid-to-gas ratio at the inlet of the compressor is more than 1% and less than 5% with reference to the rated mass flow of the compressor. It is to be noted that, in the embodiment of FIG. 1, part of the detergent liquid substance stops against the struts and/or the inlet guide vanes and does not reach the first stage of the compressor. Thanks to the high quantity of the liquid, a good washing is achieved.

In an embodiment, the liquid-to-gas ratio is more than 1% and less than 3%, more particularly about 2%; these ratios are very good compromises between the quantity of liquid and the disturbance to the operation of the compressor and the whole gas turbine engine.

It is to be noted that the liquid-to-gas ratio is commonly referred to as WAR [Water-to-Air Ratio] as the liquid is usually water and the gas is usually air.

In an embodiment, the pressure of the detergent liquid substance to be sprayed is more than 0.2 MPa and less than 2.0 MPa (this is the pressure at the end of the conduit internal to the spraying nozzle just before spraying, i.e. with reference to FIG. 2 in the area of portion 21-2). In another embodiment, the pressure of the detergent liquid substance to be sprayed is more than 0.8 MPa and less than 1.2 MPa. Thanks to the high pressure and the high speed of the liquid, a good atomization is achieved and, therefore, a good mix of liquid and gas is obtained and low disturbance to the operation of the compressor is caused and no (or very low) mechanical damages to the components of the compressor.

With reference to the exemplary embodiment of FIG. 2, the diameter of the portion 21-2 is in the range of 1.0-2.0 mm (for example 1.8 mm) the diameter of the nozzle 4 is in the range of 10-20 mm (for example 18 mm), the pressure in the portion 21-2 is in the range of 0.2-2.0 MPa (typically 0.8-1.2 MPa) and the speed in the portion 21-2 is in the range of 5-30 m/sec (for example 22 m/sec).

The combination of high liquid-to-gas ratio and high liquid pressure is synergic for achieving a good washing during operation of the engine.

Other important aspects for good performances are: the distance between the points of liquid ejection and the external wall (see e.g. elements 2 and 12 in the embodiment of FIG. 1) of the inlet path of the compressor, the distance between the points of liquid ejection and the internal wall (see e.g. elements 3 and 13 in the embodiment of FIG. 1) of the inlet path of the compressor, and the spraying direction (see e.g. element 4 in the embodiment of FIG. 1); when choosing these parameters the gas flow has to be considered. A comfortable position for spraying the liquid is front of the compressor from its mouth (see e.g. element 4 in the embodiment of FIG. 1).

Especially for "on-line" washing, a very appropriate liquid is pure water.

Figure 3:
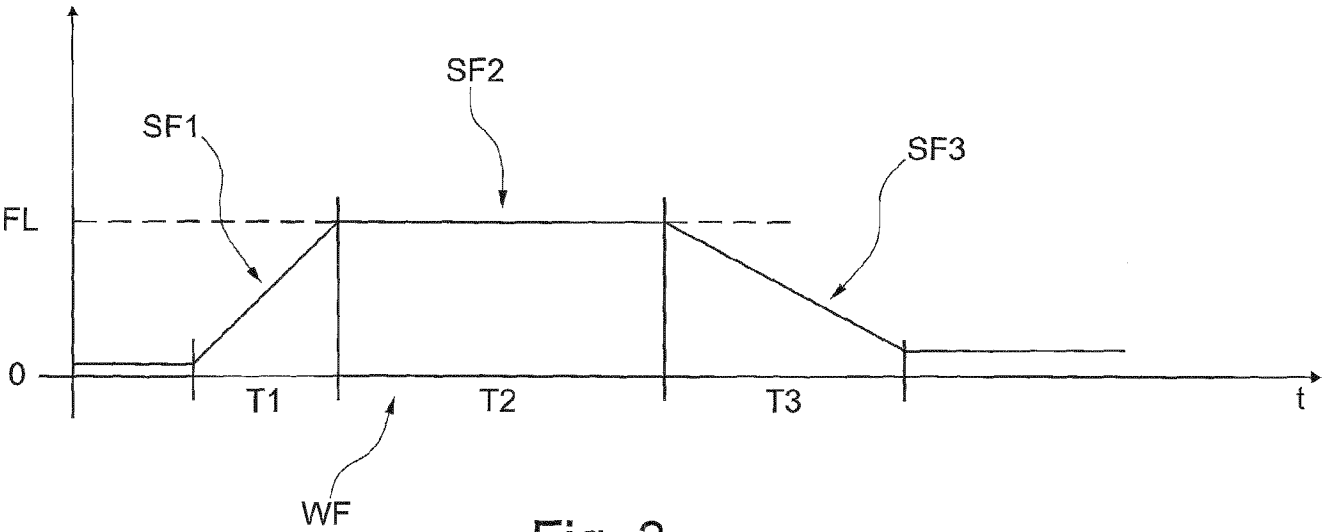
FIG. 3 shows a time diagram of an embodiment of a washing phase.

The washing phase WF shown in FIG. 3 comprises a first sub-phase SF1 during which the flow of the detergent liquid substance is increased gradually (from zero to e.g. a desired value FL), a second sub-phase SF2 during which the flow of the detergent liquid substance is maintained constant (for example at the desired value FL), and optionally, a third sub-phase SF3 during which the flow of the detergent liquid substance is decreased gradually (from the desired value FL to zero).

The gradual increase is beneficial in that the mix of fluid through the compressor varies gradually. For the same reason, the gradual decrease is beneficial even if slightly less important. Anyway, alternative washing phases are possible; for example, during the second sub-phase, the flow may not be constant and/or its flow value may depend on the operating conditions of the compressor.

The flow value is increased until a desired value FL is reached and then is maintained substantially constant at the desired value FL. The desired value FL is set on the basis of ambient conditions, more particularly on ambient temperature.

When the ambient temperature is cold the compressor sucks more air, since the latter is denser, and consequently a higher amount of water is injected to maintain the water-to-air ratio constant.

On the contrary, if the ambient temperature is hot, the air is less dense and the injected amount of water is reduced.

The second sub-phase SF2 lasts for a predetermined period of time T2 that is more than 0.5 minutes and less than 5 minutes; more particularly, it lasts 1-2 minutes; so it is quite short. The first sub-phase SF1 lasts for a predetermined period of time T1 that is more than 5 seconds and less than 30 seconds; so it is quite long if compared to the second sub-phase SF2. The third sub-phase SF3 lasts for a predetermined period of time T3 that is more than 5 seconds and less than 30 seconds; so it is quite long if compared to the second sub-phase SF2. The first sub-phase SF1 and the third sub-phase SF3 may have the same duration.

The predetermined period of time depends on gas turbine efficiency, in particular on the evolution of compressor pressure ratio over time.

During the normal operation of the gas turbine dirt particles tend to accumulate on the compressor. Over time the compressor pressure ratio gradually decreases limiting the performance of the gas turbine.

Before washing the gas turbine the compressor pressure ratio may be substantially decreased with respect to the design compressor pressure ratio.

In an embodiment, the predetermined period of time used for the washing phase is calculated as a function of the ratio between the actual compressor pressure ratio and the design compressor pressure ratio, which substantially indicates the compressor efficiency. When the ratio reduces below a predetermined threshold, for example 5%, it might be appropriate to online wash the gas turbine.

Figure 4:
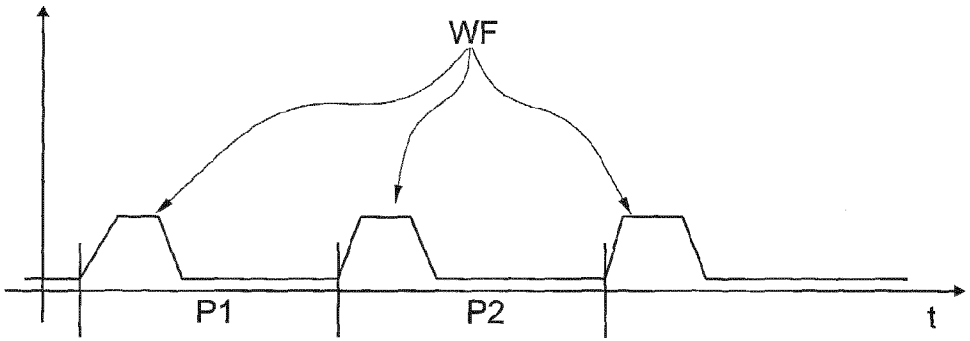
FIG. 4 shows a time diagram of a sequence of washing phases according to FIG. 3.

Very good results are achieved if the washing phase WF is repeated a number of times in a day, in particular a predetermined number of times for a predetermined time length, as it is shown in FIG. 4; in this figure, the time period between a washing phase and the following one is different (see references P1 and P2), but it may be easier to repeat it periodically. Under normal operating conditions, the number of repetition per day is selected in the range from 1 to 10 and, typically about 4.

Thanks to the above mentioned measures and with appropriate precautions, the washing phases may be carried out at any time during operation; no washing is necessary when starting and when stopping the gas turbine engine.

What has just been described, in particular the nozzle solution and the washing process solution are typically applied to a gas turbine engine, in particular to its compressor (see for example FIG. 1).

Some of the features of the washing process may be implemented through the design of the nozzle 4 in the embodiment of FIG. 1.

Some of the features of the washing process may be implemented through the control unit 19 in the embodiment of FIG. 1.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of washing a gas turbine engine during operation of the gas turbine engine, the method comprising:

a washing phase that comprises spraying a detergent liquid substance towards an inlet of a compressor of the gas turbine engine;

wherein a mass flow of the detergent liquid substance to be sprayed is set so that a liquid-to-gas ratio at the inlet of the compressor is more than 1% and less than 5% with reference to a rated mass flow of the compressor, and wherein the washing phase comprises:

a first sub-phase during which the mass flow of the detergent liquid substance is increased gradually, and a second sub-phase during which the mass flow of the detergent liquid substance is maintained constant.

2. The method of claim 1, wherein the washing phase further comprises a third sub-phase during which the mass flow of the detergent liquid substance is decreased gradually.

3. The method of claim 1, wherein the mass flow of the detergent liquid substance during the second sub-phase is constant at a desired value.

4. The method of claim 3, wherein the mass flow value of the detergent liquid substance is set on a basis of ambient conditions.

5. The method of claim 1, wherein the second sub-phase lasts for a predetermined period of time that is more than 0.5 minutes and less than 5 minutes.

6. The method of claim 2, wherein at least one of the first sub-phase or the third sub-phase lasts for a predetermined period of time that is more than 5 seconds and less than 30 seconds.

7. The method of claim 1, wherein the washing phase lasts for a predetermined period of time that depends on gas turbine efficiency.

8. The method of claim 7, further comprising the steps of:

providing a design compressor pressure ratio;

measuring an actual compressor pressure ratio; and calculating the predetermined period of time as function of a ratio between the actual compressor pressure ratio and the design compressor pressure ratio.

9. The method of claim 1, wherein the washing phase is repeated a predetermined number of times in a day for a predetermined time length.

10. The method of claim 9, wherein the predetermined number of times the washing phase is repeated is more than 1 and less than 10.

11. The method of claim 1, wherein a pressure of the detergent liquid substance to be sprayed is more than 0.2 MPa and less than 2.0 MPa.

12. The method of claim 1, wherein the detergent liquid substance is sprayed at a certain distance from an external wall of an inlet path of the compressor and at a certain distance from a internal wall of the inlet path of the compressor and in a certain direction.

13. The method of claim 1, wherein the detergent liquid substance is sprayed in front of the compressor.

14. The gas turbine engine comprising:

the compressor, a turbine downstream of the compressor, a plurality of nozzles configured to spray a detergent liquid substance towards the inlet of the compressor; and a control unit configured to carry out the method according to claim 1.

15. The method of claim 2, wherein the mass flow of the detergent liquid substance during the second sub-phase is constant at a desired value.

16. The method of claim 3, wherein the mass flow value of the detergent liquid substance is set on a basis of ambient temperature.

17. The method of claim 1, wherein the detergent liquid substance is sprayed from a mouth of the compressor.

* * * * *